US009078506B1

(12) United States Patent
Gullickson

(10) Patent No.: US 9,078,506 B1
(45) Date of Patent: Jul. 14, 2015

(54) TOE SEPARATOR BAND FOR PEDICURES

(71) Applicant: Naoemi P. Gullickson, Staten Island, NY (US)

(72) Inventor: Naoemi P. Gullickson, Staten Island, NY (US)

( * ) Notice: Subject to any disclaimer, the term of this patent is extended or adjusted under 35 U.S.C. 154(b) by 0 days.

(21) Appl. No.: 13/930,231

(22) Filed: Jun. 28, 2013

Related U.S. Application Data

(60) Provisional application No. 61/666,184, filed on Jun. 29, 2012.

(51) Int. Cl.
*A45D 29/00* (2006.01)

(52) U.S. Cl.
CPC ..... *A45D 29/00* (2013.01)

(58) Field of Classification Search
CPC .. A45D 29/00; A45D 29/22; A45D 2029/008
USPC ..... 132/73, 320, 285; 2/21; D28/56, 57; 606/24
See application file for complete search history.

(56) References Cited

U.S. PATENT DOCUMENTS

| | | | | |
|---|---|---|---|---|
| 4,194,736 | A * | 3/1980 | Loafman | 473/61 |
| 4,399,595 | A * | 8/1983 | Yoon et al. | 24/303 |
| 5,692,236 | A * | 12/1997 | Prince | 2/21 |
| 6,557,853 | B2 * | 5/2003 | Huettlinger | 273/148 B |
| 6,865,748 | B2 * | 3/2005 | Young | 2/21 |
| 8,261,416 | B2 * | 9/2012 | Rothbaum et al. | 24/17 R |

* cited by examiner

*Primary Examiner* — Rachel Steitz
(74) *Attorney, Agent, or Firm* — DeLio, Peterson & Curcio, LLC

(57) ABSTRACT

Pedicure toe band separators and methods of making and using the same. Each toe band separator wraps around a single toe and is secured thereto while avoiding contact with the toenail. Once secured to the toe, the toe band separator provides a space or gap between adjacent toes and toenails so that when the toenails are painted, contact with one or more such adjacent toes and/or toenails is avoided via the toe band separators of the invention and the space/gap generated thereby. The toe band separators may be used in combination with an additional spacer, and may be reusable or single-use disposable toe bands.

9 Claims, 3 Drawing Sheets

TOE SEPARATOR BAND FOR PEDICURES

BACKGROUND OF THE INVENTION

1. Field of the Invention

The present invention is directed to a toe separator, and in particular, separating components that separate and provide space between adjacent toes on a foot, and methods of making and using the same.

2. Description of Related Art

When performing a pedicure, an individual's feet are soaked, cleaned and prepped prior to painting the toenails. Using a nail polish of choice, the toenails are then painted followed by allowing such polish to dry. It generally takes several minutes for the nail polish to dry. During this drying time it is common that the individual may move her/his feet and/or toes while the nail polish is still wet, thereby causing the nail polish on one or more toes to become damaged, or even all together destroy.

One technique to avoid the problem of damaged or destroyed nail polish is to wrap a towel or tissue paper around and between the individual's toes. In doing so, the towel or tissue paper is typically twisted in a braided-like fashion, and then wrapped around and between each of the individual's toes so that adjacent toes are separated from one another all at once. The exposed toenails may then be painted. However, this approach is not only time consuming to prepare the twisted/braided paper, it is also uncomfortable to the user since the paper can become very thick during the twisting and/or braiding thereof as well as during the process of wrapping it around the toes. It is also difficult to put on a shoe with such twisted/braided paper, and the paper often becomes dislodged from the user's toes.

Another approach to avoid damaged and/or destroyed nail polish is to use a single-structure toe separator 10 as shown in FIG. 1. These toe separators are typically made of a foam material and include at least four, sometimes five or six, raised protrusions. The raised protrusions are provided between adjacent toes on a user's foot so that each toe is spaced apart from its respective adjacent toes. This spacing provides a void between the toenails so that adjacent toenails do not contact one another.

However, foam toe separators as shown in FIG. 1 are also plagued by problems since the raised protrusions are often thick causing too large a gap between the user's toes leading to discomfort for the user. Foam toe separators also cannot be worn with shoes (e.g., flip flops, etc.). Further, salons are usually limited in supplies these foam separators, thereby requiring the user to wait in the salon until his/her toenails are dry so that the salon may retain such foam toe separator. In addition, it is often difficult to retain foam toe separators between a user's toes, such that, these types of toenail separators also often become dislodged from the user's toes.

Accordingly, a need continues to exist in the art for new and improved toe and toenail separators that are easy to use, comfortable and will stay on the user's toes so that the painted toenails may dry to completion without damage thereto.

SUMMARY OF THE INVENTION

Bearing in mind the problems and deficiencies of the prior art, it is therefore an object of the present invention to provide toe and toenail separators that are easy to use.

It is another object of the present invention to provide toe and toenail separators that are comfortable for the user.

A further object of the invention is to provide toe and toenail separators that are securely fastened to or around the user's toes.

It is yet another object of the present invention to provide methods of using toe and toenail separators in accordance with the various embodiments of the invention.

Still other objects and advantages of the invention will in part be obvious and will in part be apparent from the specification.

The above and other objects, which will be apparent to those skilled in the art, are achieved in the present invention which is directed to a pedicure toe separating device that includes a strip of material having a length sufficient to wrap around a toe of a user. The strip of material also has a width that prevents the material from contacting the user's toenail, and has a thickness that provides a gap between such toe and one or more adjacent toes and toenails. The pedicure toe separating device also includes a first fastening segment on a first surface and residing adjacent a first end of the length of the strip of material, and a second fastening segment on a second surface and residing adjacent a second end of the strip of material. Together, the strip of material and the first and second fastening segments forming a toe band separator, whereby the first and second fastening segments reside at opposite ends of the strip of material and on said opposite sides thereof. The strip of material wraps around the toe, and the first and second fastening segments attach together to secure the strip of material to the toe and provide the gap between the toe and one or more adjacent toes and toenails while avoiding contact with the toenail.

In other embodiments, the invention is also directed to a pedicure toe separating device that includes a strip of material having a length sufficient to wrap around a toe of a user and having a width that prevents the material from contacting the user's toenail. A first fastening segment resides on a first surface of the strip of material adjacent a first end thereof. Together, the strip of material and the first fastening segment form a toe band separator whereby the strip of material wraps around the toe and the first fastening segment attaches to a second side of the strip of material, whereby the toe band separator provides a gap between the toe and one or more adjacent toes while avoiding contact with the toenail.

In still other embodiments, the invention is further directed to a method of performing a pedicure on one or more toes on a foot by wrapping a toe band separator of the invention around a desired toe, and fastening opposites ends of such toe band separator together to secure it to the toe. The toe band separator avoids contact with a toenail of the toe and provides spacing between the toe and one or more adjacent toes and toenails. A nail polish is applied to the toenail, and then allowed to dry whereby the toe band separator and spacing prevent adjacent toes and toenails from contacting the pained toenail. The toe band separator may be removed once the nail polish is dry.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-3B of the drawings in which like numerals refer to like features of the invention.

Referring again to prior art toe separators, e.g., foam toe separators and braided/twisted paper, these types of known toe separators are cumbersome, uncomfortable to wear, are stiff, spread all of the user's toes at once, fall off easily and often cannot be worn with shoes, such as, flip flops. The various embodiments of toe band separators of the invention solve the problems of these known prior art solutions for separating a user's toes and toenails.

Figure 1:
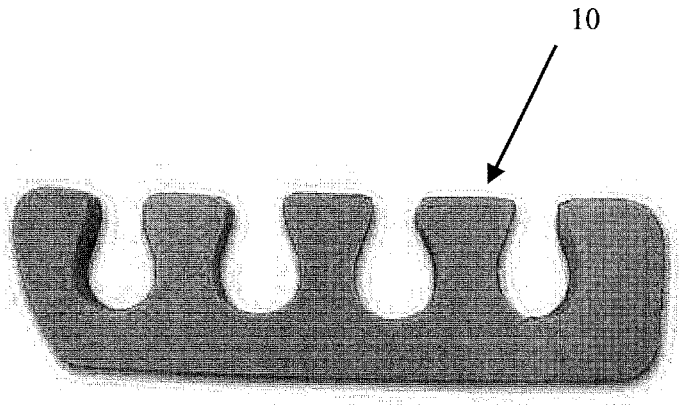
Fig. 1 PRIOR ART
FIG. 1 is a prior art toe separator.
Figure 2:
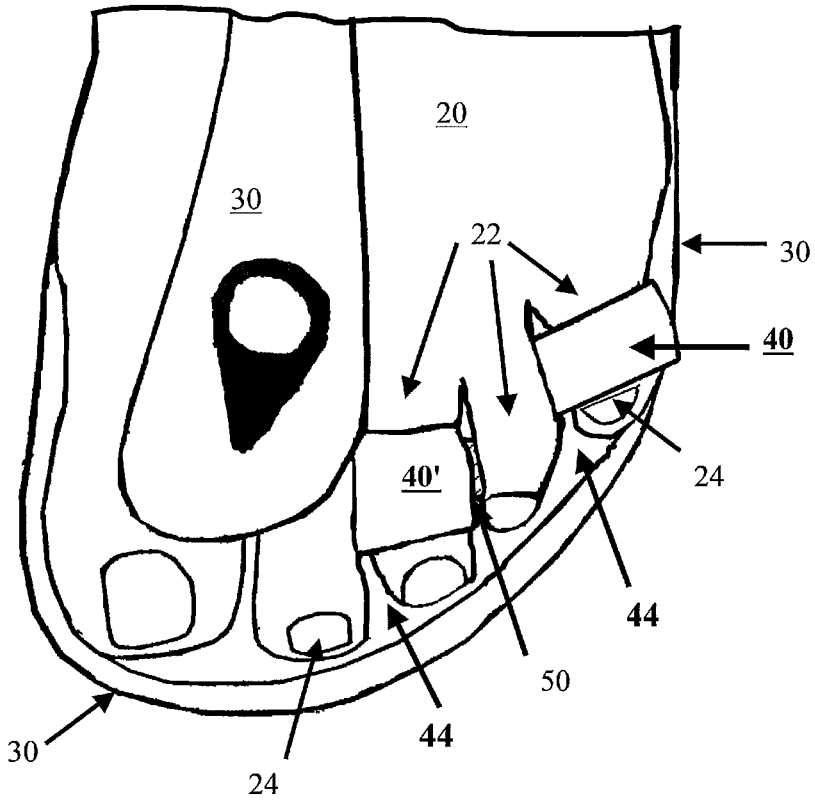
FIG. 2 illustrates a top plan view of toe separators of the invention in accordance with one or more embodiments of the invention being worn by a user.

Referring to FIG. 2, toe band separators 40 in accordance with one or more embodiments of the invention are shown from a top plan view. The toe band separators 40 are positioned around and secured to select ones of an individual's toes 22 on his/her foot 20. The user may secure one or more of the toe band separators 40 of the invention around any desired toe to provide a space or gap 44 residing between adjacent toes 22 such that the toenails 24 thereon such toes are separated from one another. That is, the user does not need to provide a toe band separator 40 around every toe on his/her foot since at least two (or more) individual toe band separators may be used to separate all the toes on an individual foot.

Figure 3A:
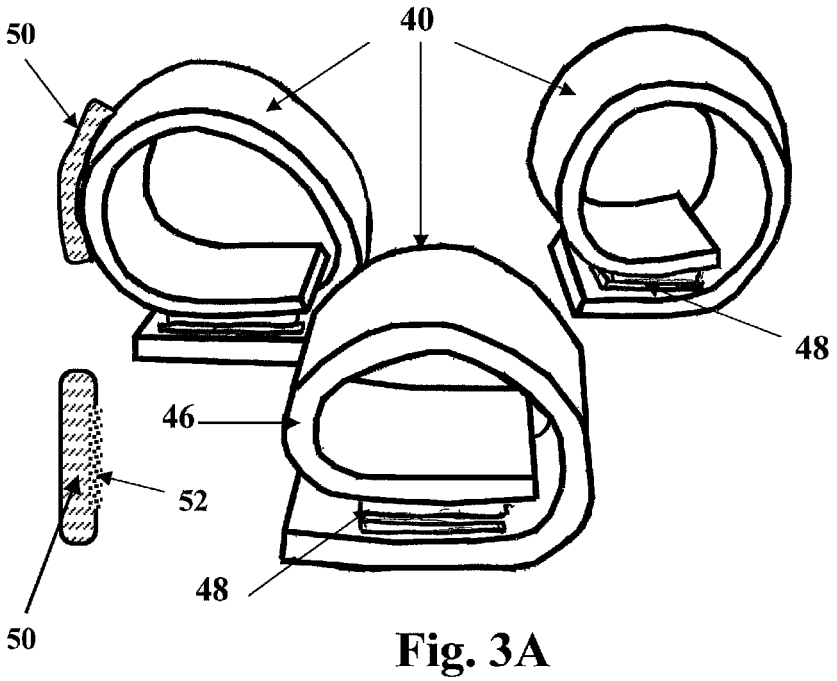
FIG. 3A illustrates a side perspective view of toe separators of the invention as shown in FIG. 2.
Figure 3B:
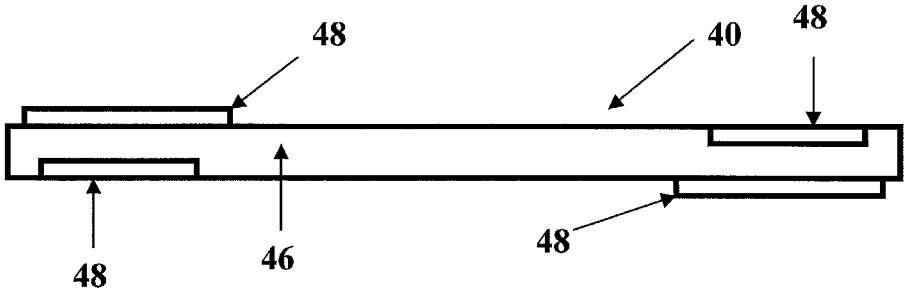
FIG. 3B illustrates a side view of toe separators of FIG. 3A.

As shown in FIG. 3A-B each toe band separator 40 comprises a single strip of material that has a thickness sufficient to separate adjacent toes from one another. In accordance with one or more embodiments of the invention, the toe band separators 40 may be composed of a soft cushioning material that provides ease of wear by the end user. In one or more embodiments the toe band separators 40 may be composed of a foam material, e.g., a cross-linked polyethylene foam, having a thickness sufficient to separate one toe from another. In other embodiments the toe band separators 40 may be composed of a stretchable material (e.g., spandex, etc.) filled with a fill material that provides cushioning and separation. The toe band separators 40 of the invention may be composed of various other materials and/or fills, so long as such constituents provide adequate separation between adjacent toes and toenails.

In various embodiments of the invention, the instant toe band separators 40 may have a thickness 42 of about 1/32 inches to about inches (or even more or less), preferably from about 1/16 inches to about 1/4 inches. The thickness 42 of the toe bands 40 is preferably of a sufficient size that provides the user with comfort and ease of wearing such toe bands 40, while also providing for sufficient separation between adjacent toes and toenails. In certain embodiments, the instant toe band separators 40 may be used in conjunction with a separating spacer 50 having an adhesion component 52 for attachment to the toe band 40.

In the event the thickness 42 of a toe band 40 is insufficient in separating adjacent toes and toenails from one another, the user may attach the separating spacer 50 (as shown in FIG. 3A) to either the first or second surface of the toe band separator to add extra separation and space to the gap 44 residing between adjacent toes. It should be appreciated that while FIG. 3A shows the separating spacer 50 attached to an exposed surface of the toe band, it should be appreciated that such a separating spacer 50 may also be attached to the interior, unexposed surface of the toe band. While not meant to limit the invention, in one or more embodiments the spacer 50 may be composed of a foam material having an adhesive strip as the adhesion component 52 for attachment to a toe band separator 40 of the invention.

The length of the toe band separators may vary so as to accommodate and wrap around the circumference of various size toes 22. For instance, in one or more embodiments the toe band separator 40 may have a length sufficient to wrap around the big toe of a user's foot 20, while in other embodiments the toe band separators 40 have a length sufficient to wrap around the little toe of such user's foot. The width of each toe band separator 40 may also vary, or alternatively may be fixed. The width of each toe band separator is sufficient so long as it extends along the length of each toe, and preferably does not contact any adjacent toenails. While not meant to limit the invention, as an example of the invention, each toe band separator may be made of a polyethylene foam material having dimensions including a length of about 3 inches, a width of about 1/2 of an inch, and a thickness of about 1/16 of an inch.

Referring to FIG. 3B, each toe band separator 40 of the invention also has fastening segments 48. The fastening segments 48 may reside at ends along the length of each toe band separator, such that, when the toe band is wrapped around a user's toe a first of the fastening segment 48 meets, contacts and adheres with a second of the fastening segments 48 residing on the opposite side of the toe band separator 40. While not meant to limit the invention, the fastening segments 48 may include any material that is capable of adhering together to form a secure connection there-between. For instance, the fastening segments 48 may include a magnetic material (e.g., magnetic vinyl), a hook and loop connection (e.g., Velcro), adhesive, a fastening snap, hook or button, and the like, or even combinations thereof.

In various embodiments of the invention the fastening segments 48 may be provided directly inside the toe band separators 40 at opposite ends and opposite sides along the length of such toe band. For instance, in those embodiments where the toe band separators are composed of a material filled with a fill component, the fastening segments may be provided inside the material and secured at the opposite ends along the length of such toe bands.

In accordance with the various embodiments of the invention, the toe band separators of the invention may be formed using a sheet of cross-linked polyethylene foam, whereby such material is cut into the instant toe band separators. The fastening segments 48 may be secured to an outside surface of the toe bands 40 at opposite ends and on opposite sides thereof. Alternatively, in those embodiments wherein the toe band separators are composed of an outer material and a fill material, such components may be sewn and filled, with the fastening segments 48 being provided and secured either inside or outside such toe bands.

During use of the various embodiments of the instant toe band separators 40, each toe band separator 40 is wrapped around a single toe 22 so that the thickness 46 of the toe band 40 provides a space or gap 44 between adjacent toes 22 and corresponding toenails 24. The fastening means 48 secures the toe band separator to the toe, such that the toe band separator is snugly wrapped around the entire toe. For instance, in those embodiments including a magnetic fastening means, the toe band wraps completely around a toe with the ends thereof overlapping and being held together by the two magnetic fastening segments.

In the various embodiments, the toe band separators 40 of the invention only wrap around the toes selected for separation from other toes, and as such, avoid the uncomfortable and burdensome prior art problem of separating all toes at once. The end result is a comfortable toe band separator that wraps around selected toe(s) to create separation between desired toes only. That is, the toe band separators 40 of the various embodiments of the invention provide comfortable, individual toe separation as needed, and eliminate the uncomfortable stiffness and over-spreading of toes of prior art toe separators.

The instant toe band separators 40 also avoid dislodging from the user's toes since they are securely held in position around the user's toes via the fastening segments. Since the toe band separators 40 of the invention wrap around individual toes only, the instant toe bands allow a user to wear open-toe shoes (e.g., flip flops, sandals, etc.) to allow the toenails to properly dry without adjacent toes and/or toenails contacting one another, thereby avoiding any potential damage to the polish on such nails. Once a user provides and secures one or more toe band separators 40 of the invention on his/her toe(s), a separation or gap 44 is provided between adjacent toes, and the toenails may be painted. Again, the toe bands of the invention may be worn with open toe shoes to separate toes and allow for complete and smudge free air drying of the toenail polish.

In accordance with the various embodiments, the toe band separators 40 of the invention may be reusable or disposable. In the disposable toe band separator embodiments of the invention, the instant toe band separators 40 may be composed of a biodegradable material (e.g., biodegradable paper) to form disposable toe band (e.g., a disposable quilted paper toe band 40) having a fastening means (e.g., an adhesive peel off closure). These embodiments may be useful and cost effective for use in spas and salons, which often implement and prefer single-use, disposable products for sanitary and ease of use reasons.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A pedicure toe separating device comprising:

a strip of material comprising a first and a second sheet of material having a length sufficient to wrap around a toe of a user, the strip of material having a width that prevents the material from contacting the user's toenail and having a thickness that provides a gap between said toe and one or more adjacent toes and toenails;

a first fastening segment on a first surface of the strip of material, the first fastening segment residing adjacent a first end of the length of the strip of material on said first surface thereof;

a second fastening segment on a second surface of the strip of material, the second fastening segment residing adjacent a second end of the length of the strip of material on said second surface thereof;

together said strip of material and said first and second fastening segments forming a toe band separator whereby the first and second fastening segments are provided within an interior cavity residing between said first and second sheets of material of said toe band separator and said first and second fastening segments reside at opposite ends of said strip of material, and on said opposite sides thereof, said strip of material wraps around said toe and said first and second fastening segments attach together to secure said strip of material to said toe and provide said gap between said toe and said one or more adjacent toes and toenails while avoiding contact with said toenail, an inside surface of said toe band separator residing and contacting said toe and an outside surface of said toe band separator residing on the opposite side of the inside surface adjacent said one or more adjacent toes; and a spacer attached to said outside surface of said toe band separator to provide additional space to said gap for further separating said toe and said one or more adjacent toes and toenails.

2. The device of claim 1 wherein the strip of material comprises a foam material.

3. The device of claim 1 wherein the strip of material having a first and second sheet comprises a woven material.

4. The device of claim 1 wherein the strip of material having a first and second sheet comprises a non-woven material.

5. The device of claim 1 wherein said first and second fastening segments comprise opposite pole magnets.

6. The device of claim 1 wherein said toe band separator comprises a reusable toe band separator.

7. The device of claim 1 wherein said toe band separator comprises a single-use, disposable toe band separator, and said spacer being permanently attached to said outside surface of said toe band separator.

8. The device of claim 1 further including said spacer being removable attached to said outside surface of said toe band separator.

9. The device of claim 1 further comprising:

said first and second sheet of material having a width of about ½ inch so as to prevent the material from contacting the user's toenail and having said thickness ranging from 1/16 to ½ inch to provide said gap between said toe and one or more adjacent toes and toenails;

said first and second fastening segments comprising opposite pole magnets provided within said interior cavity of said toe band separator; and said spacer being a removably attachable separating spacer attached to the outside surface of the toe band separator to provide additional space to the gap for further separating the toe and the one or more adjacent toes and toenails, the separating spacer having an adhesion component for attachment to the toe band separator.

* * * * *